US005915302A

United States Patent [19]

Baba et al.

[11] Patent Number: 5,915,302

[45] **Date of Patent: *Jun. 29, 1999**

[54] PRINTER INK EXCHANGE APPARATUS

[75] Inventors: Yasuyuki Baba; Arifumi Okamoto; Kunio Niuchi, all of Mihara, Japan

[73] Assignee: Mitsubishi Jukogyo Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,237

[22] Filed: Sep. 16, 1997

Related U.S. Application Data

[63] Continuation of application No. 08/638,140, Apr. 26, 1996, abandoned.

[30] Foreign Application Priority Data

Apr. 27, 1996 [JP] Japan ..... 7-104079

[51] Int. Cl.[6] ..... B41F 31/06; B41F 31/08; B41F 31/20

[52] U.S. Cl. ..... 101/366; 101/425

[58] Field of Search ..... 101/423, 425, 101/350.1, 350.2, 350.5, 355, 356, 357, 360, 363, 365, 366, 207, 208, 210; 118/259

[56] References Cited

U.S. PATENT DOCUMENTS

| | | | |
|---|---|---|---|
| 3,025,793 | 3/1962 | Vischulis | 101/350 |
| 3,800,702 | 4/1974 | Roberts | 101/425 |
| 4,369,734 | 1/1983 | Preuss | 101/425 X |
| 4,526,102 | 7/1985 | Grobman | 101/425 |
| 5,325,780 | 7/1994 | Matsuda et al. | 101/424 |
| 5,367,982 | 11/1994 | DeMoore et al. | 101/425 |

FOREIGN PATENT DOCUMENTS

| | | |
|---|---|---|
| 0338403 | 10/1989 | European Pat. Off. . |
| 4-128841 | 11/1992 | Japan . |
| 22670961 | 11/1993 | United Kingdom . |

*Primary Examiner*—J. Reed Fisher

*Attorney, Agent, or Firm*—Rothwell, Figg, Ernst & Kurz, p.c.

[57] ABSTRACT

To provide a printer ink exchange apparatus which can ① greatly shorten a wash liquid recovery time, ② dissolve a dilution by the residual wash liquid in the ink circulation and supply passage so that a lowering of the ink viscosity (density) can be prevented and ③ dissolve a mixing of the ink of the previous order in the ink circulation and supply passage so that the ink for a new order is prevented from becoming turbid, and as a result, can enhance the productivity and the printing quality. At the time of washing, the selector valve 26 is switched to the direction of the ink tank 4, wash liquid is supplied from the wash liquid pipe 16 to the ink circulation and supply mechanism, same as in the conventional ink exchange apparatus, the ink circulation and supply mechanism is washed and the waste liquid (wash liquid after used for washing) is recovered into the waste recovery unit 25, then the ink tank 4 in which ink for a new order is contained and the ink supply pipe 8 of the ink circulation and supply mechanism are connected together, the selector valve 26 is switched to the direction of the waste liquid recovery unit 25, ink 3 is supplied for a certain time, and together with said ink 3, the residual waste liquid (residual wash liquid) is forcibly discharged into the waste liquid recovery unit 25. In this state, when a certain time passes, or when the color of returning liquid comes to a certain deepness, the selector valve 26 is switched to the direction of the ink tank 4, the ink 3 for a new order is circulated in the ink circulation and supply mechanism and the ink 3 is supplied between the inking rolls 1, 2 of the printing unit.

5 Claims, 5 Drawing Sheets

PRINTER INK EXCHANGE APPARATUS

This is a continuation of application Ser. No. 08/638,140, filed Apr. 26, 1996 now abandoned.

BACKGROUND OF THE INVENTION

1. Field of the Invention

The present invention relates to an ink exchange apparatus for use in a flexographic printer etc. in which an ink exchange at the time of a color change accompanying with an order change is automatically made.

2. Description of the Prior Art

An ink exchange apparatus used in a flexographic printer in the prior art is described with reference to FIGS. 4(*a*), (*b*) and 5. A usual ink exchange apparatus used in a flexographic printer, as shown in FIG. 4(*a*), comprises an ink circulation and supply mechanism for circulating ink between one of ink tanks and a printing unit and supplying the ink to the printing unit; an ink tank exchange mechanism for connecting a joint portion to the ink tank of said ink circulation and supply mechanism selectively to one of the ink tanks; and a wash liquid supply mechanism for supplying a wash liquid to said ink circulation and supply mechanism at the time of washing of said ink circulation and supply mechanism.

FIG. 4(*a*) is a perspective view of the ink exchange apparatus, FIG. 4(*b*) is a side view of the printing unit consisting of inking rolls (an anilox roll and a rubber roll), a printing cylinder and an impression roll, and FIG. 5 is a flow chart showing an operation of said ink exchange apparatus.

The printing unit of a flexographic printer is constructed as shown in FIGS. 4(*a*), (*b*). That is, numeral 28 designates the printing cylinder having a printing die 29 fitted around its outer circumferential face, numeral 30 designates an impression roll disposed opposingly to said printing cylinder 28, numeral 1 designates the anilox roll (inking roll) and numeral 2 designates the rubber roll (inking roll), all of which compose the printing unit.

Numeral 3 designates a flexographic ink and said flexographic ink 3 is supplied into a nip portion P between the anilox roll 1 and the rubber roll 2 from the ink tank 4*a* (or ink tank 4*b*) through an ink pump 7 and an ink supply pipe 8.

And the ink 3 supplied into the nip portion P is doctored by the rubber roll 2 and is transferred uniformly onto the outer circumferential face of the anilox roll 1 and is further transferred onto the printing die 29 by a contact of the surface of the anilox roll 1 and the printing die 29 fitted around the outer circumferential face of the printing cylinder 28.

On the other hand, a sheet 31, such as a corrugated board sheet, to be printed passes between the printing cylinder 28 and the impression roll 30 and comes in contact with the printing die 29, thus a desired printing is made on the sheet 31.

While the printing is being made, the ink 3*a* within the ink tank 4*a* is supplied into said nip portion P, and an excess ink 3*a* overflows from both ends of said nip portion P, flows down into end pans (ink reservoirs) 15*a*, 15*b* and returns to the ink tank 4*a* through return pipes (discharge pipes) 10*a*, 10*b*.

Thus, the ink 3*a* circulates in said ink circulation and supply mechanism while printing is made, and after a desired printing is finished, an order change (ink color change and printing die exchange) becomes necessary.

Said ink circulation and supply mechanism is further described concretely. Numerals 11*a*, 11*b* designate ink supply ports of the ink tanks 4*a*, 4*b*, numerals 5, 5 designate covers of the ink tanks on which said ink supply ports 11*a*, 11*b* are provided and numeral 12 designates a joint provided at the lower end portion of the ink supply pipe 8, and said joint 12 is fitted detachably to either one of the ink supply ports 11*a*, 11*b*.

Numeral 13 designates a filter provided in the middle of the ink supply pipe 8, numeral 7 designates an ink pump provided on the upper side of said filter 13 in the middle of said ink supply pipe 8 and numeral 14 designates an ink funneling device provided at the upper end portion of the ink supply pipe 8, and said ink funneling device is disposed immediately above the nip portion between the anilox roll 1 and the rubber roll 2.

Numerals 15*a*, 15*b* designate end pans disposed immediately below both end portions of the anilox roll 1 and the rubber roll 2, numerals 10*a*, 10*b* designate return pipes (discharge pipes) elongating from said end pans 15*a*, 15*b*, and numeral 10 designates a return pipe (discharge pipe) connecting to said return pipes 10*a*, 10*b*, and the lower end portion of said return pipe 10 connects to either one of return ports 6*a*, 6*b* of the ink tanks 4*a*, 4*b*.

Next, said wash liquid supply mechanism is described concretely. Numeral 16 designates a wash liquid pipe, and said wash liquid pipe 16 connects to the ink supply pipe 8 via a solenoid valve 18 and a T-type joint 17.

Next, said ink tank exchange mechanism is described concretely. Numeral 20 designates a joint elevating cylinder, numeral 21 designates a bucket driving cylinder, numeral 22 designates a holder driving cylinder, numeral 23 designates a holder, numeral 25 designates a waste liquid bucket and numeral 32 designates a bracket connecting the joint 12 and the return pipe 10.

The operation of the ink exchange apparatus at the time of an order change is as follows:

As shown in FIG. 4(*a*), the joint 12 and the return pipe (discharge pipe) 10 are connected each other by the bracket 12 and are movable together in any direction of front and rear, right and left or up and down.

In FIG. 5, (*a*), (*b*), (*c*) and (*d*) show a flow chart at the time of an ink exchange, wherein FIG. 5(A) shows a state of ink circulation and supply (state of ink supply start), FIG. 5(*b*) shows a state of ink recovery and FIG. 5(*c*) shows a state of ink washing by a wash liquid.

First, by stopping the ink pump 7, the ink circulation in the ink circulation passage is stopped, and as shown in FIG. 5(*b*), the ink is recovered into the ink tank 4*a* for a certain time by a timer setting.

Next, by a recovery finish signal, the bracket 32 connecting the joint 12 and the recovery pipe (discharge pipe) 10 is elevated and is moved back, and as shown in FIG. 5(*c*), the joint 12 and the lower end portion of the return pipe 10 are moved to a position aside the ink tank 4*a*, that is, a predetermined position above the waste liquid bucket 25, and are stopped.

In this state, the solenoid valve 18 is opened, wash liquid is automatically supplied toward the ink funneling device 14 through the ink supply pipe 8 of the ink circulation and supply passage from the wash liquid pipe 16 via the T-type joint 17, and the insides of the ink supply pipe 8 and the ink funneling device 14 are washed, and further the ink of the nip portion between the anilox roll 1 and the rubber roll 2, the ink in the end pans 15*a*, 15*b* and the ink in the return pipes 10*a*, 10*b*, 10 are washed off.

In the meantime, the anilox roll 1 and the rubber roll 2 are making idle running and the firstly used ink sticked on the outer circumferential faces of both rolls 1, 2 and on the insides of both roll shaft end portions and the end pans 15*a*, 15*b* are washed off.

At the same time, the wash liquid is automatically supplied to the direction of the ink tank 4*a* through the ink supply pipe 8 from the wash liquid pipe 16 via the T-type joint 17, and the ink of the insides of the ink supply pipe 8, the ink pump 7, the filter 13 and the joint 12 is also washed off.

With the operation as above, all the wash liquid is discharged into the waste liquid bucket 25 from the return pipes 10*a*, 10*b*, 10 and from the ink supply pipe 8 via the opening port joint 12. Supply of the wash liquid is controlled by a time adjustable timer etc., and with a signal given after a certain time passes, the solenoid valve 18 is closed and the supply of wash liquid is stopped. Even after the supply of wash liquid is stopped, each device is kept stopped in that state, recovery of the wash liquid is continued for a certain time, then by a signal from the timer of the recovery finish, the next operation is carried out.

That is, by moving the bracket 32, the joint 12 is moved to the ink supply port 11*b* of the ink tank 4*b* in which ink for the next new order is contained, and the end portion of the return pipe 10 is moved to the return port 6*b* of the ink tank 4*b*, respectively, the movement of the bracket 32 is stopped, then the bracket 32 is let down, and the joint 12 is moved to the ink supply port 11*b* as shown in FIG. 4(*a*) and is automatically connected thereto. Likewise, the end portion of the return pipe 10 is connected to the return port 6*b*.

In this state, the ink pump 7 is started, ink for the next new order is circulated in the ink circulation and supply passage and a printing by use of the ink of the new order is carried out.

In the ink exchange apparatus used in the flexographic printer in the prior art, as shown in FIGS. 4 and 5, upon finishing of a printing by use of ink of the previous order, the ink pump 7 is stopped, the circulating ink is recovered into the presently used ink tank (of the previous order), then the connection of the lower end portion of the ink circulation passage (the lower end portions of the ink supply pipe 8 and the return pipe 10) and the ink tank 4*a* is released, the lower end portion of the ink circulation passage is moved above the waste liquid bucket 25 by the ink tank exchange mechanism, the wash liquid supply mechanism is worked, the ink circulation passage is washed by the wash liquid, the turbid wash liquid after used for washing is discharged into the waste liquid bucket 25, then supply of the wash liquid is stopped and the turbid wash liquid is recovered for a certain time by a natural discharge. Then, the lower end portion of the ink circulation passage is connected to the ink tank 4*b* of the next new order and a printing by use of ink of the new order is commenced.

This means that after the supply of wash liquid is stopped, a natural discharge is carried out until the turbid wash liquid is recovered. For this reason, a considerable time is required for the recovery of wash liquid of the roll nip portion or the circulation passage. In actual cases where a preference is put on a productivity, however, a next printing (supply of ink) is reopened before the liquid recovery is completely made, and in such case, upon commencement of ink circulation, the residual wash liquid in the roll nip portion or in the circulation passage returns into the ink tank, the ink there is diluted so that the viscosity of ink is lowered or the ink of a new order is discolored by mixing of the residual ink of the previous order, hence there is such a problem that a printing quality is lowered or the ink of a new order becomes unusable.

SUMMARY OF THE INVENTION

It is therefore an object of the present invention to provide an ink exchange apparatus for use in a flexographic printer etc. which can ① greatly shorten a wash liquid recovery time, ② dissolve a dilution by the residual wash liquid in the ink circulation and supply passage so that a lowering of the ink viscosity (density) can be prevented and ③ dissolve a mixing of the ink of the previous order remaining in the ink circulation and supply passage so that the ink of a new order is prevented from becoming turbid, and, as a result, can enhance the productivity and the printing quality.

In order to attain the above-mentioned object, in a printer ink exchange apparatus according to the present invention comprising a plurality of ink tanks; an ink circulation and supply mechanism for circulating ink between one of said ink tanks and a printing unit and supplying the ink to the printing unit; an ink tank exchange mechanism for connecting a joint portion to the ink tank of said ink circulation and supply mechanism selectively to one of the ink tanks; a wash liquid supply mechanism for supplying a wash liquid to said ink circulation and supply mechanism at the time of washing of said ink circulation and supply mechanism; and a waste liquid recovery unit for recovering a waste liquid after said ink circulation and supply mechanism is washed by the wash liquid, said ink circulation and supply mechanism comprises a waste liquid discharge line for discharging said waste liquid to said waste liquid recovery unit. (Claim 1)

In said printer ink exchange apparatus as claimed in claim 1, said waste liquid discharge line comprises a selector valve provided at the end portion of a return pipe to the ink tank of said ink circulation and supply mechanism for switching a passage of liquid to the direction of said waste liquid recovery unit and to the direction of said ink tank; and a waste liquid discharge pipe elongating from said selector valve to said waste liquid recovery unit. (Claim 2)

In said printer ink exchange apparatus as claimed in claim 2, a three-way valve is used as said selector valve. (Claim 3)

In said printer ink exchange apparatus as claimed in claim 2, out of liquid passages composing said waste liquid discharge line, either one of that in the direction of said waste liquid recovery unit and that in the direction of said ink tank is made a preferential passage, and a two-way valve provided at said preferential passage is used as said selector valve. (Claim 4)

In said printer ink exchange apparatus as claimed in claim 2, out of liquid passages composing said waste liquid discharge line, that in the direction of said waste liquid recovery unit and that in the direction of said ink tank are separated each other at an ink reservoir, either one of them is made a passage for suction by a discharge pump, the other is made a passage for natural flow, and a two-way valve provided at said the other passage is used as said selector valve. (Claim 5)

In the printer ink exchange apparatus according to the present invention constructed as described above, at the time of washing, the selector valve is switched to the direction of the ink tank, wash liquid is supplied to the ink circulation and supply mechanism, same as in the conventional ink exchange apparatus, the ink circulation and supply mechanism is washed and the waste liquid (wash liquid after used for washing) is recovered into the waste recovery unit, then the ink tank in which ink for a new order is contained and the ink supply pipe of the ink circulation and supply mechanism are connected together, the selector valve is switched to the direction of the waste liquid recovery unit, ink is supplied for a certain time, and together with said ink, the residual waste liquid (residual wash liquid) is forcibly discharged into the waste liquid recovery unit. In this state, when a certain time passes, or when the color of returning liquid comes to a certain deepness, the selector valve is switched to the direction of the ink tank, the ink for a new order is circulated in the ink circulation and supply mechanism and the ink is supplied to the printing unit.

DESCRIPTION OF THE PREFERRED EMBODIMENTS

Figure 1:
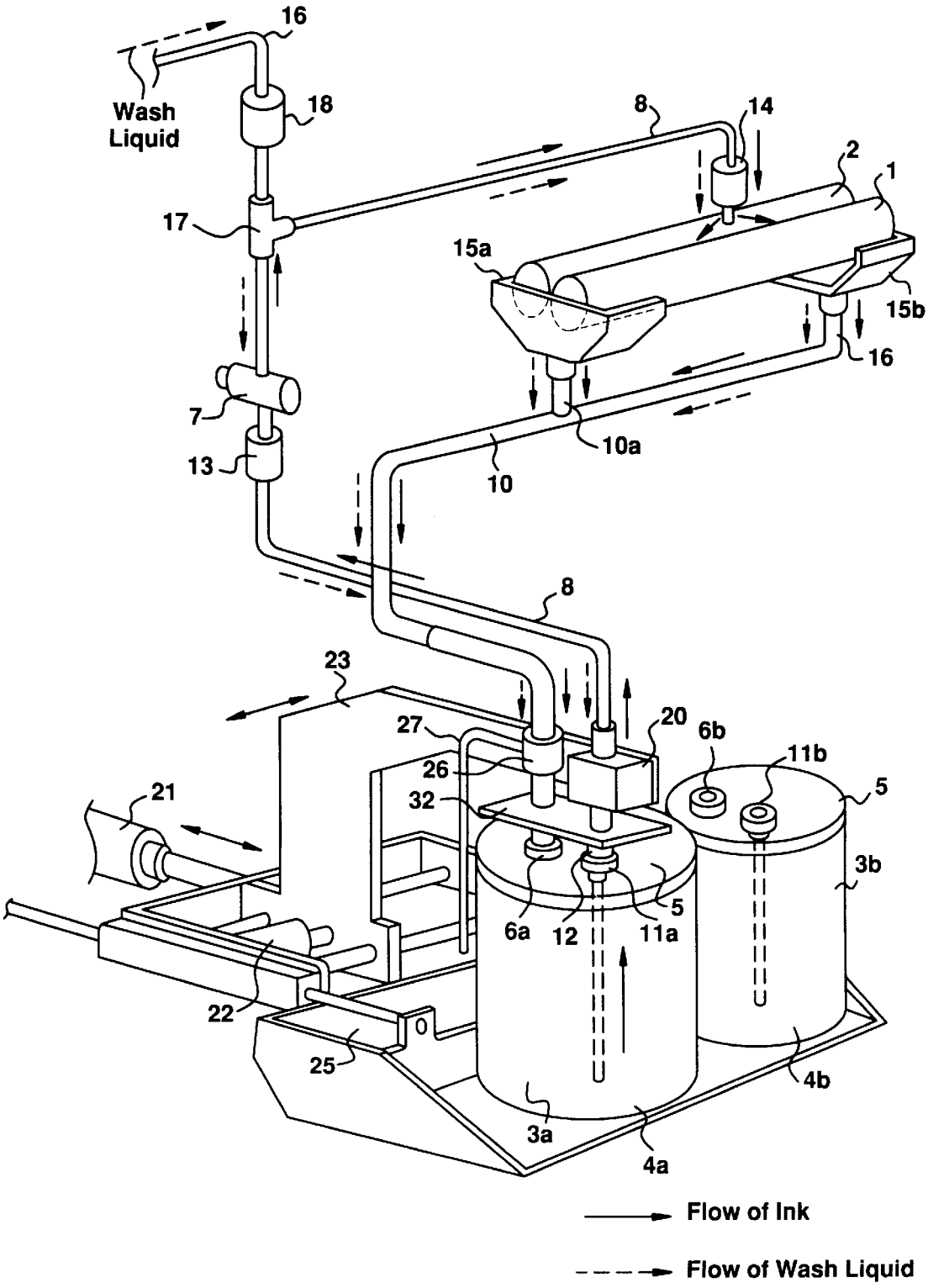
FIG. 1 is a perspective view showing one preferred embodiment of a printer ink exchange apparatus according to the present invention.
Figure 2A:
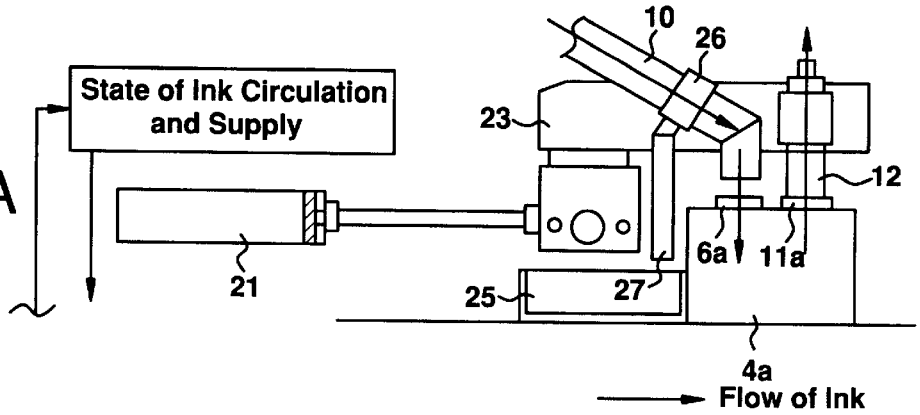
FIG. 2 is a flow chart, wherein FIG. 2(*a*) shows a state of ink circulation and supply, FIG. 2(*b*) shows a state of ink recovery, FIG. 2(*c*) shows a state of ink washing by use of wash liquid and FIG. 2(*d*) shows a state of ink supply start.
Figure 2B:
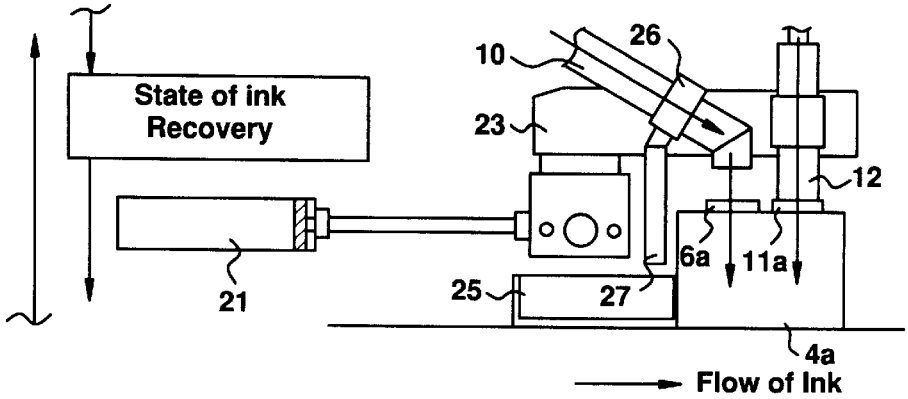
Figure 2C:
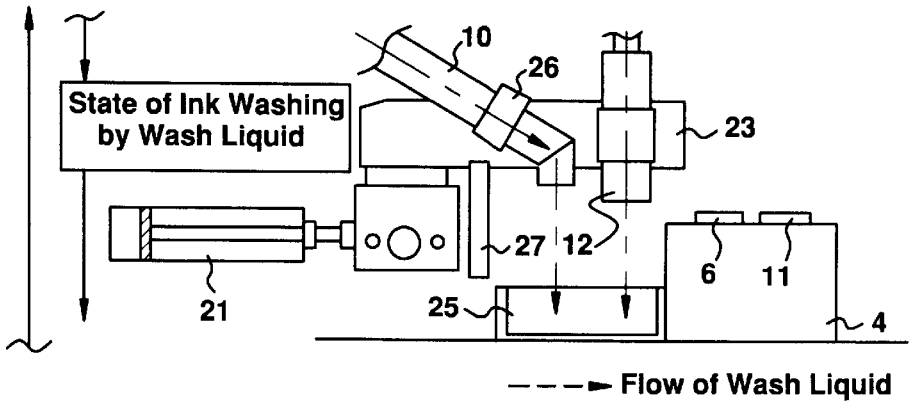
Figure 2D:
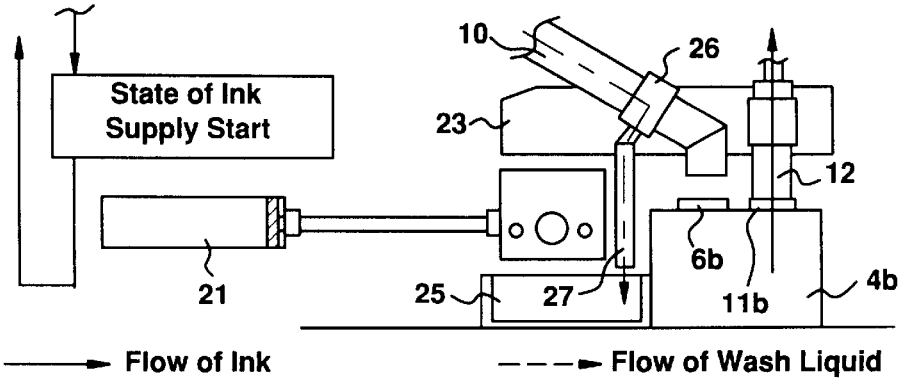

A printer ink exchange apparatus according to the present invention is described based on one preferred embodiment applied to a flexographic printer as shown in FIGS. 1 and 2. FIG. 1 is a perspective view of said ink exchange apparatus and FIG. 2 is a flow chart showing functions (operation status) of said ink exchange apparatus.

In FIGS. 1 and 2, numeral 1 designates an anilox roll, numeral 2 designates a rubber roll, numeral 3 designates a flexographic ink, numerals 4*a,* 4*b* designate ink tanks, numerals 5, 5 designate covers of said ink tanks 4*a,* 4*b,* numerals 6*a,* 6*b* designate return ports provided on said covers 5, 5, numeral 7 designates an ink pump, numeral 8 designates an ink supply pipe, numeral 10 designates a return pipe (discharge pipe), numerals 11*a,* 11*b* designates supply ports provided on said covers 5, 5, numeral 12 designates a joint, numeral 13 designates a filter, numeral 14 designates an ink funneling device, numerals 15*a,* 15*b* designate end pans, numeral 16 designates a wash liquid pipe, numeral 17 designates a T-type joint, numeral 18 designates a solenoid valve, numeral 20 designates a joint numeral 21 designates a bucket driving cylinder, numeral 22 designates a holder driving cylinder, numeral 23 designates a holder, numeral 25 designates a waste liquid bucket (waste liquid recovery unit), numeral 26 designates a three-way valve (selector valve) and numeral 27 designates a waste liquid discharge pipe.

Incidentally, the construction and the function of a printing unit in the flexographic printer are same as those in the conventional ones.

Next, operation of the ink exchange apparatus in the flexographic printer is described concretely.

When a printing of certain order is finished and an ink exchange is made for another order, the ink pump 7 is stopped, a starting button of a control circuit (not shown in the figure) of the ink tank exchange mechanism is switched on and the ink exchange work is started.

That is, from a state of FIG. 2(*a*), the ink pump is first stopped and, as shown in FIG. 2(*b*), the ink in the ink circulation and supply passage is recovered into the ink tank 4*a.* At this time, the three-way valve 26 is switched to the direction of the ink tank 4*a.*

When a certain time set by a timer passes from said state and ink recovery is finished, then upon a recovery finish signal, as shown in FIG. 2(*c*), the ink supply pipe 8 and the joint 12 fitted at its lower end portion are elevated by the joint elevating cylinder 20, and then the holder 23 is moved back by the holder driving cylinder 22, and the joint 12 of the ink supply pipe 8 and the lower end portion of the return pipe (discharge pipe) 10 are moved above the waste liquid bucket (waste liquid recovery unit) 25.

In this state, the solenoid valve 18 is opened, wash liquid is automatically supplied toward the anilox roll 1 and the rubber roll 2 from the wash liquid pipe 16 via the T-type joint 17, and the inside of the ink supply pipe 8 and the inside of the ink funneling device 14 are washed. Further, the ink in the roll nip portion, the ink in the end pans 15*a,* 15*b* and the ink in the return pipes 10*a,* 10*b,* 10 are washed off.

At this time, the anilox roll 1 and the rubber roll 2 are making idle running and the firstly used ink sticked on the outer circumferential faces of both rolls 1, 2 and on the insides of both roll shaft end portions and end pans 15*a,* 15*b* are washed off.

On the other hand, the wash liquid is also automatically supplied toward the ink tank 4*a* from the wash liquid pipe 16 via the T-type joint 17, and the ink of the inside of the ink supply pipe 8 and the ink of the insides of the ink pump 7, the filter 13 and the joint 12 are washed off.

With the work as above, all the wash liquid is discharged from the lower end portion of the return pipe 10 and the joint 12 of the ink supply pipe 8.

Supply and stop of the wash liquid are controlled by a time adjustable timer etc., and upon a signal given after a certain time passes, the solenoid valve 18 is closed, the supply of wash liquid is stopped and the next process is commenced.

That is, upon the supply of wash liquid being stopped, recovery of the wash liquid is carried out for a certain time. Then, the holder driving cylinder 22 is worked, and the joint 12 of the ink supply pipe 8 and the lower end portion of the return pipe 10, both supported movably in the upward and downward directions by the holder 23, are transferred to the right in FIG. 1 and stopped so that the joint 12 positions correspondingly to the supply port 11*b* of the ink tank 4*b* in which a new ink for the next order is previously contained and the lower end portion of the return pipe 10 positions correspondingly to the return port 6*b.*

Upon finish of the wash liquid recovery, as shown in FIG. 2(*d*), the holder 23 is advanced by the bucket driving cylinder 21, and the joint 12 on the side of the ink supply pipe 8 of the ink circulation and supply passage is let down by the joint elevating cylinder 20 so as to approach to the supply port 11*b* of the ink tank 4*b* of the next new order and is connected thereto automatically.

And the three-way valve (electromagnetic valve) 26 is switched to the direction of the waste liquid bucket (waste liquid recovery unit) 25. Then, the ink supplied by the ink pump 7 pushes out forcibly for a certain time, and is diluted itself by, the residual waste liquid (residual wash liquid) in the ink circulation and supply passage, so that the waste liquid is discharged through the waste liquid discharge pipe 27 into the waste liquid bucket (waste liquid recovery unit) 25 provided on the outside of the ink tanks.

Incidentally, said forcible discharge time is controlled by a timer setting made on experiences with feedback of a sensor detected signal of the color of the returning waste liquid, or by judgement of an operator seeing the color.

After said forcible discharge time passes, the three-way valve 26 is switched to the direction of the ink tank 4*b,* the returning ink 3*b* is recovered into the ink tank 4*b,* and the ink 3*b* in the ink tank 4*b* is circulated in the ink circulation and supply mechanism and is supplied to the printing unit.

Thus, as the residual waste liquid (residual wash liquid) is forcibly discharged by the ink for a new order, the ink exchange time is greatly shortened. And as the diluted ink is not returned to the ink tank, a lowering of the ink viscosity is prevented.

Figure 3A:
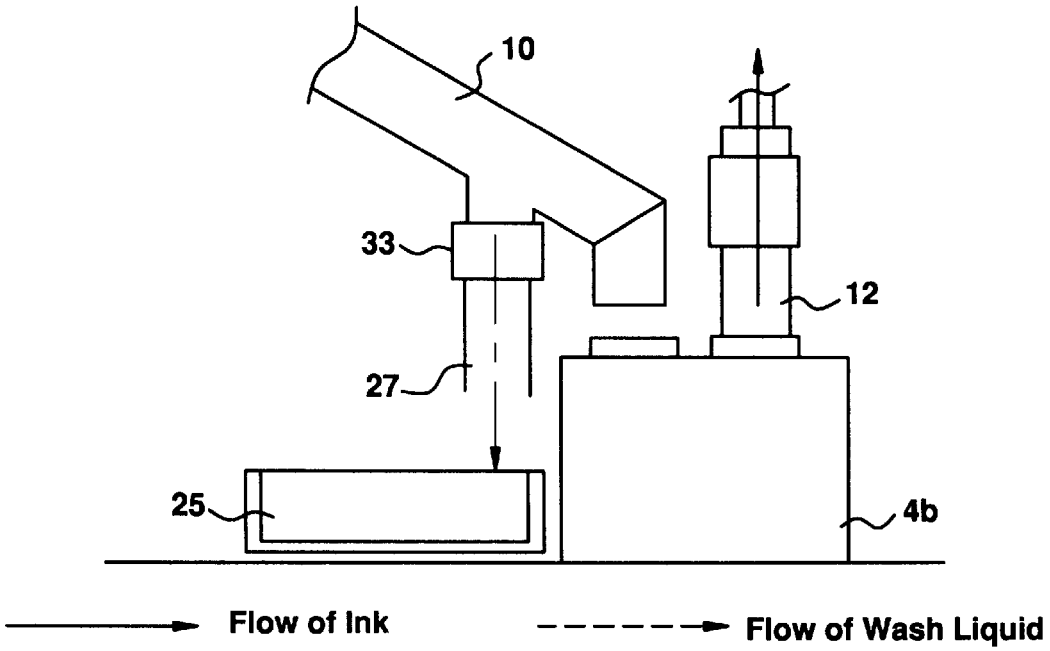
FIG. 3(*a*) is a side view showing a case where a two-way valve is provided in the middle of the return pipe and FIG. 3(*b*) is a side view showing a case where a two-way valve is provided at an ink reservoir.
Figure 3B:
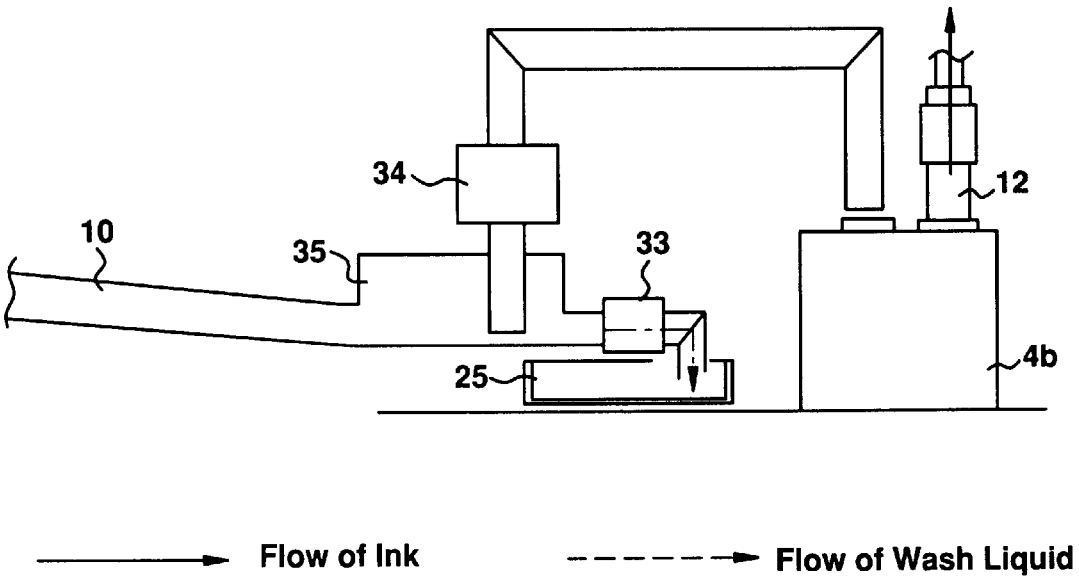
Figure 4A:
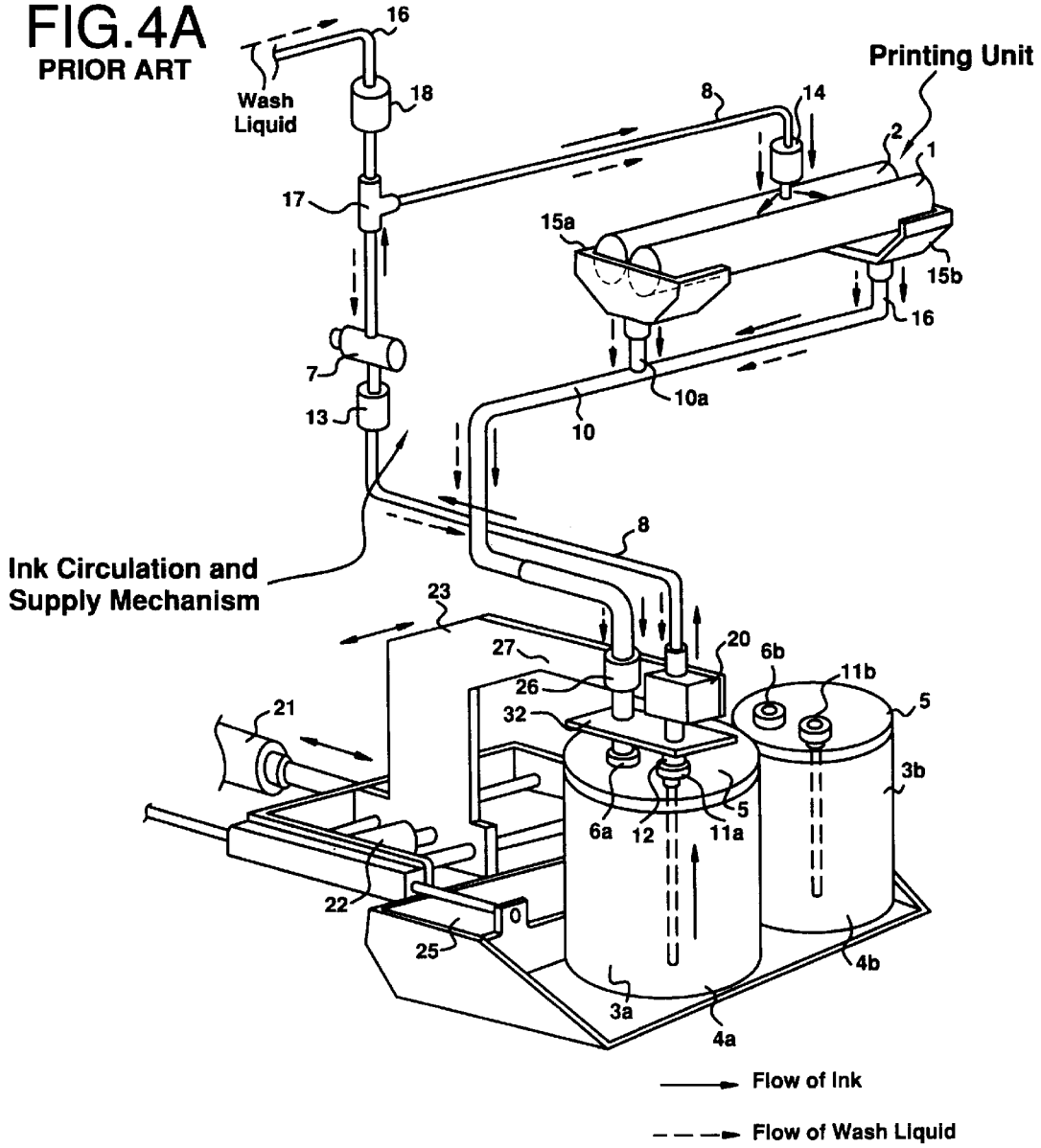
FIG.4A PRIOR ART
FIG. 4(*a*) is a perspective view showing an ink exchange apparatus used in a flexographic printer in the prior art and FIG. 4(*b*) is a side view showing the printing unit.
Figure 4B:
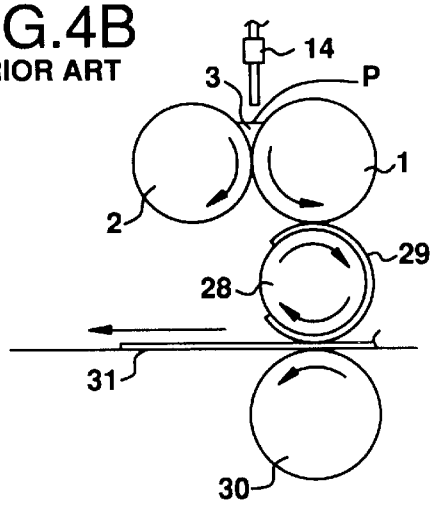
FIG.4B PRIOR ART
Figure 5A:
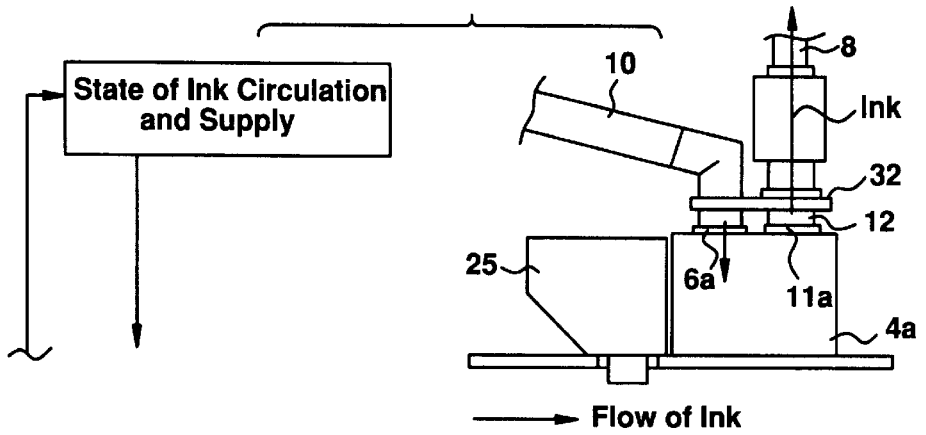
FIG.5A PRIOR ART
FIG. 5 is a flow chart, wherein FIG. 5(*a*) shows a state of ink circulation and supply, FIG. 5(*b*) shows a state of ink recovery, FIG. 5(*c*) shows a state of ink washing by use of wash liquid and FIG. 5(*d*) shows a state of ink supply start.
Figure 5B:
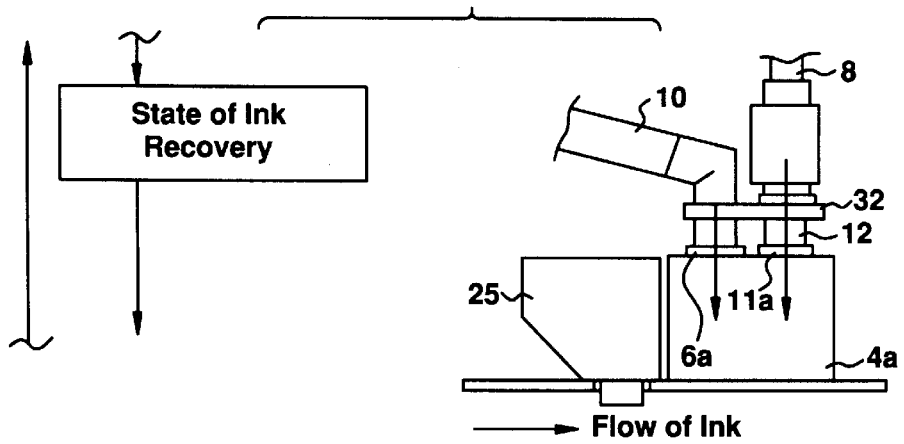
FIG.5B PRIOR ART
Figure 5C:
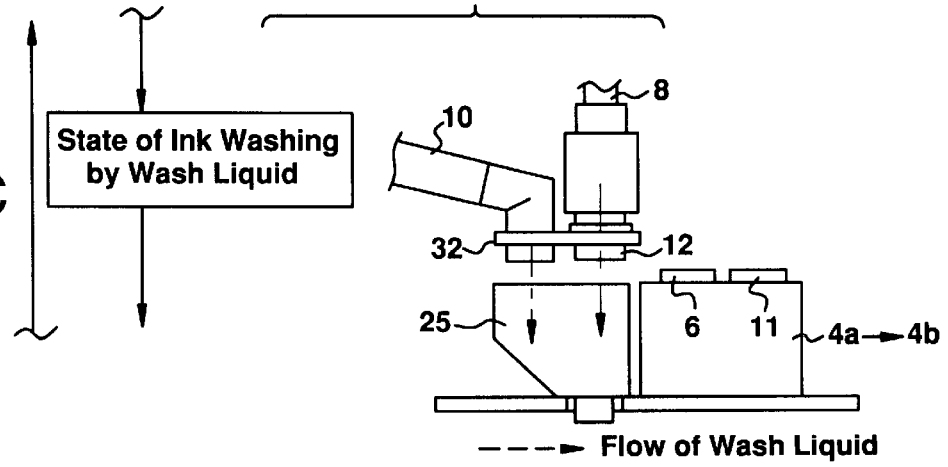
FIG.5C PRIOR ART
Figure 5D:
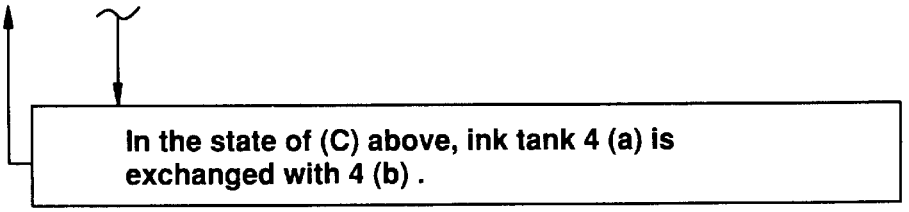
FIG.5D PRIOR ART

Incidentally, in said preferred embodiment, the three-way valve 26 is used as a selector valve, but not limited to the three-way valve, a two-way valve 33 shown in FIG. 3 may be used.

That is, in FIG. 3(*a*) which corresponds to FIG. 2(*d*), a two-way valve 33 is provided below the discharge pipe 10. FIG. 3(*b*) shows a printing unit in which ink or water returning from the return pipe 10 is once stored in an ink reservoir 35 and then is sucked up by a discharge pump 34, and in this case also, a two-way valve 33 is provided at the ink reservoir 35. In this example, the discharge pump 34 is stopped and the two-way valve 33 is opened, thereby the residual waste liquid (residual wash liquid) is prevented from mixing in the ink tank 4*b* of the new order. In such way, the two-way valve 33 may be used.

In the printer ink exchange apparatus according to the present invention as described above, at the time of washing, the selector valve is switched to the direction of the ink tank, wash liquid is supplied to the ink circulation and supply mechanism, same as in the conventional ink exchange apparatus, the ink circulation and supply mechanism is washed and the waste liquid (wash liquid after used for washing) is recovered into the waste recovery unit, then the ink tank in which ink for a new order is contained and the ink supply pipe of the ink circulation and supply mechanism are connected together, the selector valve is switched to the direction of the waste liquid recovery unit, ink is supplied for a certain time, and together with said ink, the residual waste liquid (residual wash liquid) is forcibly discharged into the waste liquid recovery unit. In this state, when a certain time passes, or when the color of returning liquid comes to a certain deepness, the selector valve is switched to the direction of the ink tank, the ink for a new order is circulated in the ink circulation and supply mechanism and the ink is supplied to the printing unit. Thereby, ① the wash liquid recovery time can be greatly shortened, ② a dilution by the residual waste liquid (residual wash liquid) in the ink circulation and supply passage can be dissolved so that a lowering of the ink viscosity (density) can be prevented, ③ a mixing of the ink of the previous order remaining in the ink circulation and supply passage can be dissolved so that the ink for a new order is prevented from becoming turbid, and as a result, the productivity and the printing quality can be enhanced.

The foregoing invention has been described in terms of preferred embodiments. However, those skilled in the art will recognize that many variations of such embodiments exist. Such variations are intended to be within the scope of the present invention and the appended claims.

What is claimed is:

1. A printer ink exchange apparatus comprising a plurality of ink tanks; an ink circulation and supply mechanism for circulating ink between one of said ink tanks and a printing unit and supplying the ink to the printing unit; an ink tank exchange mechanism including a joint portion for connecting said ink circulation and supply mechanism selectively to one of the ink tanks; a wash liquid supply mechanism for supplying a wash liquid to said ink circulation and supply mechanism at the time of washing of said ink circulation and supply mechanism; and a waste liquid recovery unit for recovering a waste liquid after said ink circulation and supply mechanism is washed by the wash liquid, wherein said ink circulation and supply mechanism comprises a waste liquid discharge line for discharging said waste liquid to said waste liquid recovery unit, wherein said waste liquid discharge line comprises a selector valve provided at an end portion of a return pipe to an ink tank of said ink circulation and supply mechanism for selectively switching liquid passage to said waste liquid recovery unit or to a respective ink tank; and a waste liquid discharge pipe extending from said selector valve to said waste liquid recovery unit, wherein said switching by said selector valve is controlled to switch after a predetermined discharge time of said ink to switch ink discharge from entering the waste liquid discharge pipe to entering the ink tank, wherein said ink circulation and supply mechanism includes an ink supply pipe and said ink return pipe, and wherein said ink tank exchange mechanism includes a mechanism that moves said ink supply pipe and said ink return pipe selectively to a position over said waste liquid recovery unit or over a selected one of said ink tanks.

2. A printer ink exchange apparatus as claimed in claim 1, wherein a three-way valve is used as said selector valve.

3. A printer ink exchange apparatus as claimed in claim 1, wherein a two-way valve is provided as said selector valve.

4. A printer ink exchange apparatus as claimed in claim 1, further comprising a discharge pump connected to said ink circulation and supply mechanism for directing said liquid passage toward one of said waste liquid recovery unit or said respective ink tank.

5. A printer ink exchange apparatus as claimed in claim 1, wherein said discharge time is controlled by a timer having a predetermined discharge time.

* * * * *